US012337245B1

(12) United States Patent
Reed

(10) Patent No.: US 12,337,245 B1
(45) Date of Patent: Jun. 24, 2025

(54) SHOPPING GAME

(71) Applicant: Christina Reed, Anchorage, AK (US)

(72) Inventor: Christina Reed, Anchorage, AK (US)

( * ) Notice: Subject to any disclaimer, the term of this patent is extended or adjusted under 35 U.S.C. 154(b) by 343 days.

(21) Appl. No.: 18/101,272

(22) Filed: Jan. 25, 2023

(51) Int. Cl.
*A63F 3/00* (2006.01)
*A63F 1/04* (2006.01)

(52) U.S. Cl.
CPC ..... *A63F 3/00003* (2013.01); *A63F 1/04* (2013.01); *A63F 3/00176* (2013.01); *A63F 2001/0475* (2013.01); *A63F 2003/00182* (2013.01)

(58) Field of Classification Search
None
See application file for complete search history.

(56) References Cited

U.S. PATENT DOCUMENTS 5,190,292 A * 3/1993 Perry ..... A63F 3/00 273/243
5,472,207 A * 12/1995 Sullivan, Jr. ..... A63F 3/00006 273/249
5,662,327 A * 9/1997 Levinrad ..... A63F 3/00006 273/242
7,914,286 B2 * 3/2011 Lees ..... A63F 3/00063 434/107
2014/0265121 A1 * 9/2014 Homer ..... G06Q 30/02 273/256

* cited by examiner

*Primary Examiner* — Sunit Pandya
(74) *Attorney, Agent, or Firm* — Michael Tavella

(57) ABSTRACT

A game that uses the Mini Brands type toys as part of a shopping game. The game comes with: a supply of mini branded package type toys, 6 mini shopping baskets, a timer capable of displaying the time remaining and making noise at the end of time, and of counting the following times (controlled by a player: 1 minute 15 seconds, 30 seconds, and 15 seconds), 14 Shopping list Cards 14 egg must buy cards, 14 milk must buy cards, 10 bread must buy cards, a 20"×20" snappable/foldable game mat, and 6 different colored dry erase markers. The players search for the toys in the tray that are on their shopping lists and place them in their baskets. These rounds continue until a player receives all three of the "must buy" cards at which point they win. The use of photos or cards depicting products can also be used.

8 Claims, 11 Drawing Sheets

SHOPPING GAME

FEDERALLY SPONSORED RESEARCH AND DEVELOPMENT

Not Applicable

Cross Reference to Related applications Not Applicable

BACKGROUND OF THE INVENTION

Field of the Invention

This invention relates to shopping games and particularly to shopping games using collectable branded miniature product toys.

Description of the Prior Art

IN 2019, a company created a toy collection known as "Mini Brands" created a series of collectible miniature product packages that are copies of the real branded products in miniature. Ranging from corn flakes, candy bars, cleaning products, potato chips, and many others, they are a popular item available today. Other companies make similar toys as well.

BRIEF DESCRIPTION OF THE INVENTION

The instant invention is a game that uses the "Mini Brands" type toys as part of a shopping game. The game uses the Mini Brand type toys as props for the players to "go shopping". The game comes with: a supply of brand name product toys, such as Mini Brand toys or similar products, 6 mini shopping baskets, a timer capable of displaying the time remaining and making noise at the end of time, and of counting the following times (controlled by player: 1 minute 15 seconds, 30 seconds, and 15 seconds), 14 shopping list cards (dry erase compatible finish), 14 egg must buy cards, 14 milk must buy cards, 10 bread must buy cards, a 20"×20" snappable/foldable game mat, and 6 different colored dry erase markers. Note, that although Mini Brands products are preferred, there is no reason why any other such products cannot be used as well. As noted above, other companies make similar products.

Moreover, cards or photo cards depicting various products can be used as well. In these cases, players pull cards out of the pile showing products that are on' their lists. All other aspects and rules still apply in this case.

At the start, the players snap the corners of the game mat together to make a tray. Then the tray is filled with the brand name product toys. Players each receive a shopping basket, a dry erase marker and a shopping list card. The time is set for one minute and 15 seconds and started. The players then search the toys in the tray for those that are on their shopping lists and place them in their baskets. At the end of time, the player with the most items from their list wins the round. That winner draws a card from the "must buy" cards and places it face up. The cards have milk, bread, and eggs, and to win the game a player must collect all three. Play continues with another round with new shopping list cards. This continues until a player receives all three of the "must buy" cards at which point they win.

DETAILED DESCRIPTION OF THE INVENTION

Figure 1:
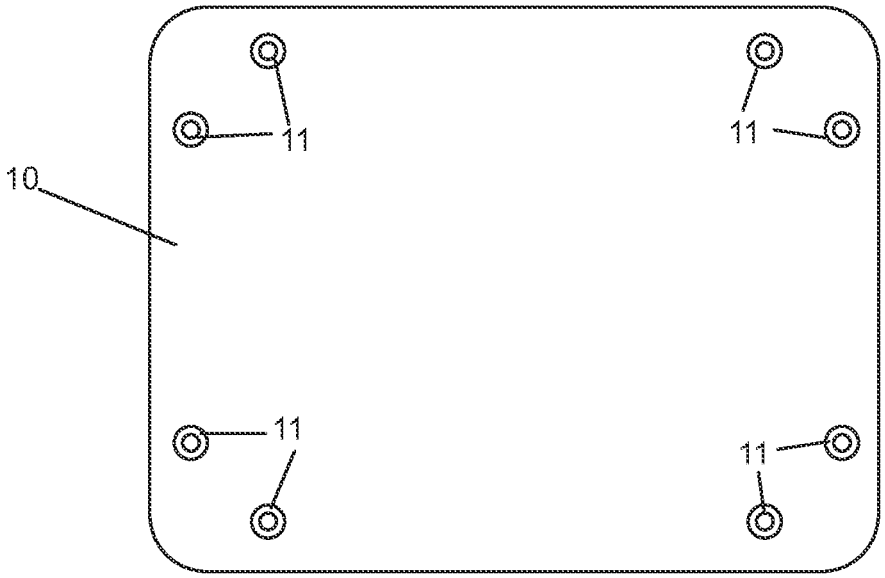
FIG. 1 is a top view of the game mat unfolded.
Figure 2:
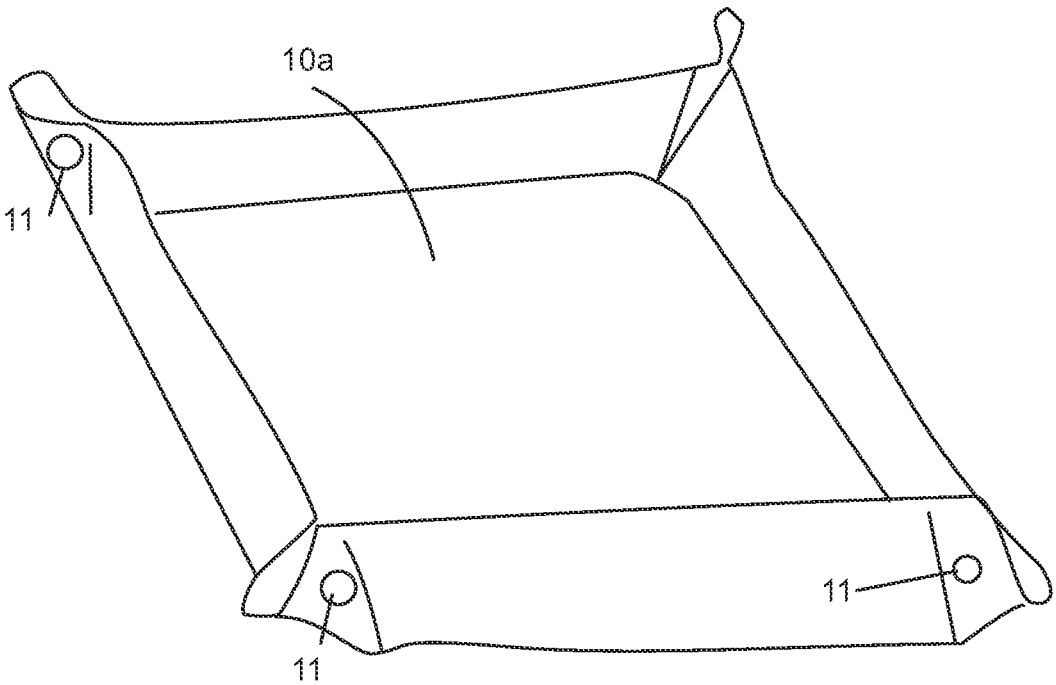
FIG. 2 is a perspective view of the game mat assembled into a tray.

Referring now to the drawings and particularly to FIGS. 1, 2 and 3, the game mat 10 is shown in FIGS. 1 and 2. The mat 10 has snaps 11 placed in the corners as shown. When stored, the game mat is kept flat and folded. For play, the snaps 11 in the corners are engaged as shown in FIG. 2. In this way, the mat 10 is transformed into a tray 10*a* that holds the toys used in the game. In the preferred embodiment, the game mat 10 is 20 inches by 20 inches. Of course, it can be made to any desired size, but the preferred size is best for a game having six players.

Figure 3A:
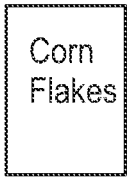
FIG. 3*a* is a detail view of a one of the simulated products used in the game.
Figure 3B:
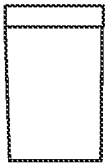
FIG. 3*b* is a detail view of another of the simulated products used in the game.
Figure 3C:
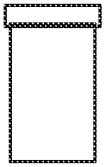
FIG. 3*c* is a detail view of yet another of the simulated products used in the game.
Figure 3D:
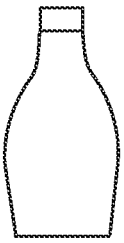
FIG. 3*d* is a detail view of yet another of the simulated products used in the game.
Figure 3E:
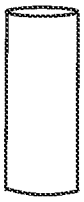
FIG. 3*e* is a detail view of yet another of the simulated products used in the game.
Figure 3F:
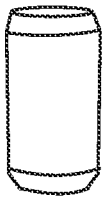
FIG. 3*f* is a detail view of yet another of the simulated products used in the game.
Figure 3G:
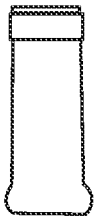
FIG. 3*g* is a detail view of yet another of the simulated products used in the game.
Figure 3H:
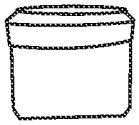
FIG. 3*h* is a detail view of yet another of the simulated products used in the game.
Figure 3I:
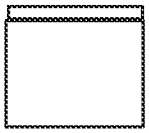
FIG. 3*i* is a detail view of yet another of the simulated products used in the game.

FIGS. 3*a*-3*i* are representative views of brand name product toys used in the game. As noted, the game consists of players "shopping" for specific brand name product toys. These brand name product toys come in a wide variety of shapes and sizes and are designed to match the real products that they represent in shape and color. Moreover, these products come in different "flavors." For example, peanut butter comes with a specific brand on it, but it may be found as "creamy" or "chunky". Potato chips can also have many variations of flavors. This makes the game more interesting, because as described below, the shopping list will have a list of products with specific flavors or styles on them. Players must select the proper product and flavor to receive credit. As shown, FIG. 3*a* is a box of cereal (corn flakes is shown on the box, but any brand name cereal can be used). FIG. 3*b* shows a peanut butter jar. FIG. 3*c* is a container of mixed nuts. FIG. 3*d* is a bottle of chocolate syrup, or maple syrup or many other foodstuffs. FIG. 3*e* is a can of stackable potato chips. FIG. 3*f* is a soft drink can. FIG. 3*g* is a jar of seasoning. FIG. 3*h* is a can of microwaveable food-anything from pasta to soup. FIG. 3*i* is a can of processed meat.

As noted, these products all have brand names on them. They come in a wide variety of shapes and labels. In the game, the number of toy products ranges between about 30 and 200. Of course, that can change as desired.

Also as noted above, there are other companies that produce similar products as Mini Brands. Moreover, the products can be depicted on cards or other media. Thus, for the purposes of this application the definition of the term "game pieces" includes Mini Brands or similar products, as well as cards or photos of the products.

Figure 3J:
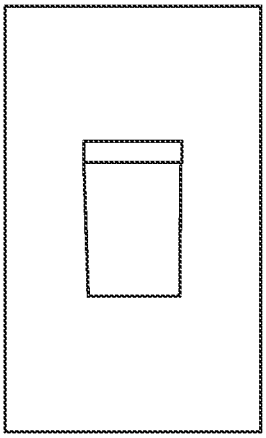
FIG. 3*j* is a detail view of a card or photo-cards depicting a product.
Figure 3K:
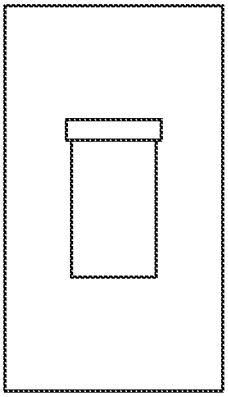
FIG. 3*k* is a detail view of a card or photo-cards depicting a product.

FIGS. 3*j*-*k* are details views of cards or photo-cards depicting various products that can be used in the game as well.

Figure 4:
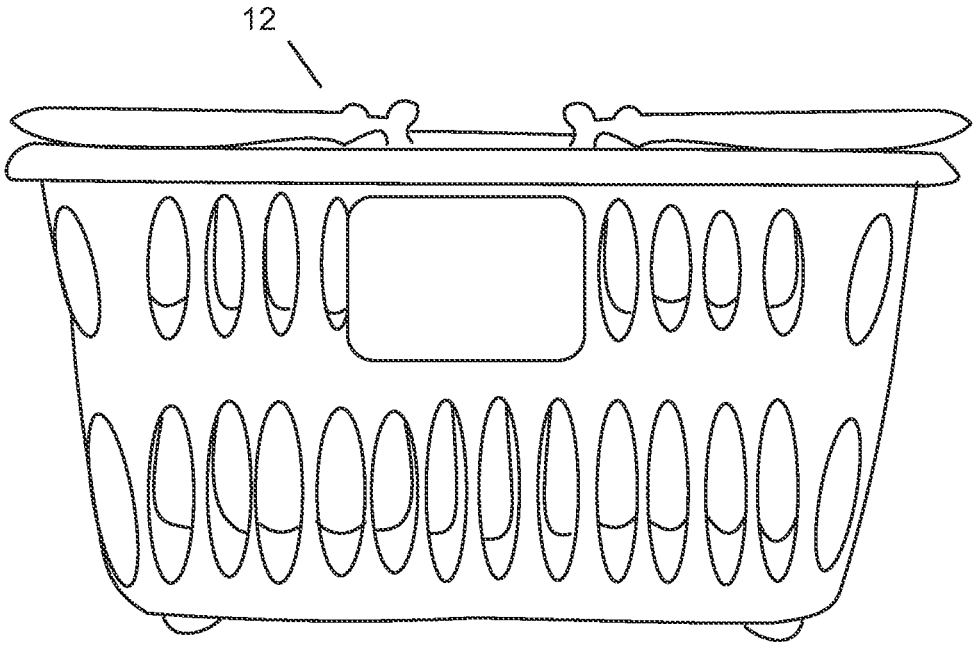
FIG. 4 is a side view of a mini shopping basket.

FIG. 4 shows a mini shopping basket 12, used in the game. The game has 6 baskets to enable 6 players to play. These baskets are miniatures of the real baskets. Players pick items from the tray 10*a* and then place them into their baskets. At the end of time, the players empty their baskets to verify that the correct products have been selected.

The game uses a number of cards for shopping lists and "must buy" cards, as described below.

Figure 5:
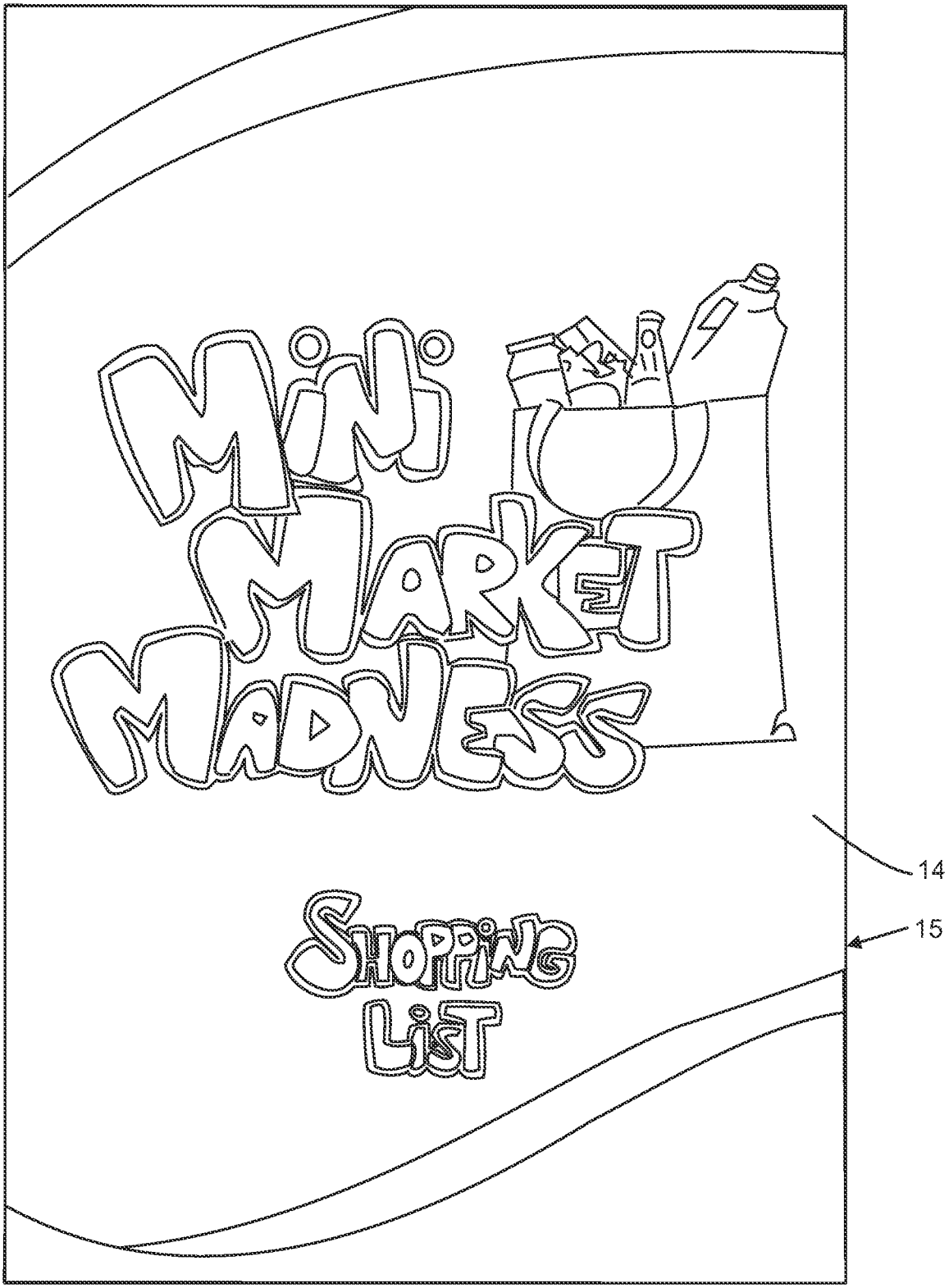
FIG. 5 is a view of the front of a shopping list card.
Figure 6:
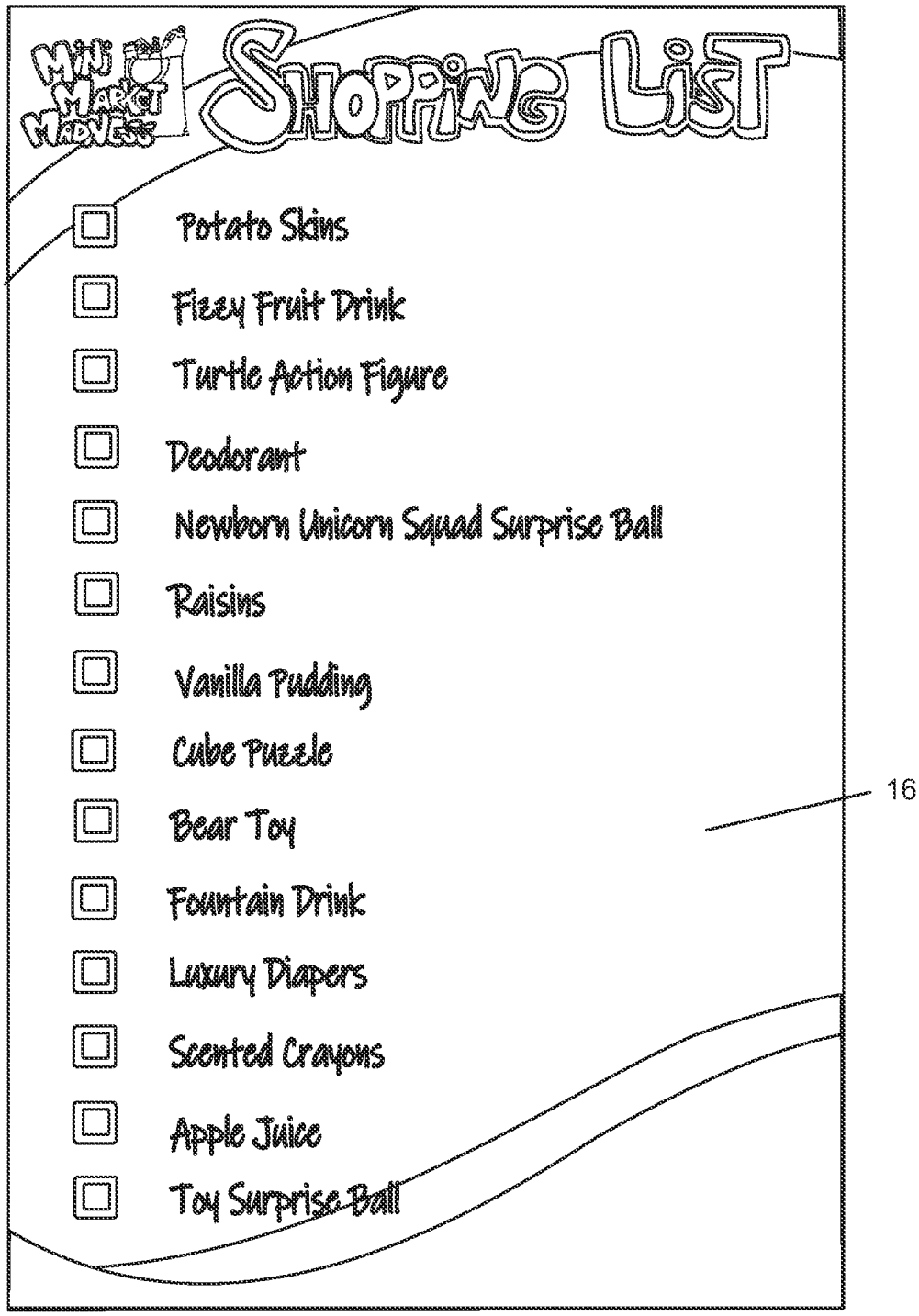
FIG. 6 is a view of the back of a representative shopping list card.

FIG. 5 is a view of the front 14 of a shopping list card 15. FIG. 6 is a view of the back 16 of a representative shopping list card 15. Here, the shopping list card lists a number of items that the player must find in the tray. In the preferred embodiment, the number of items is 14. However, the exact number can change as desired. The number listed is designed to allow players to find the items and mark them on the card before time runs out (as discussed below). Too few items and all the players could win the round. Too many, and none will be able to complete the search. At the end of time, the player with the most items wins the round. Players use dry erase markers (see FIG. 12) to mark the cards; that way, the cards can be reused. In the game, the items have actual brand names on them, and the shopping list has the same brand names. As noted above, a complication in the game comes from having more than one type of product with the same brand name. For example, for a peanut butter product, there may be both "smooth" and "chunky types". The list may call for only the "smooth". If the player takes the wrong item, it does not count-even of it has the right brand name on it. At the end of the round the winner of the round gets to select a "Must Buy" card.

Figure 7:
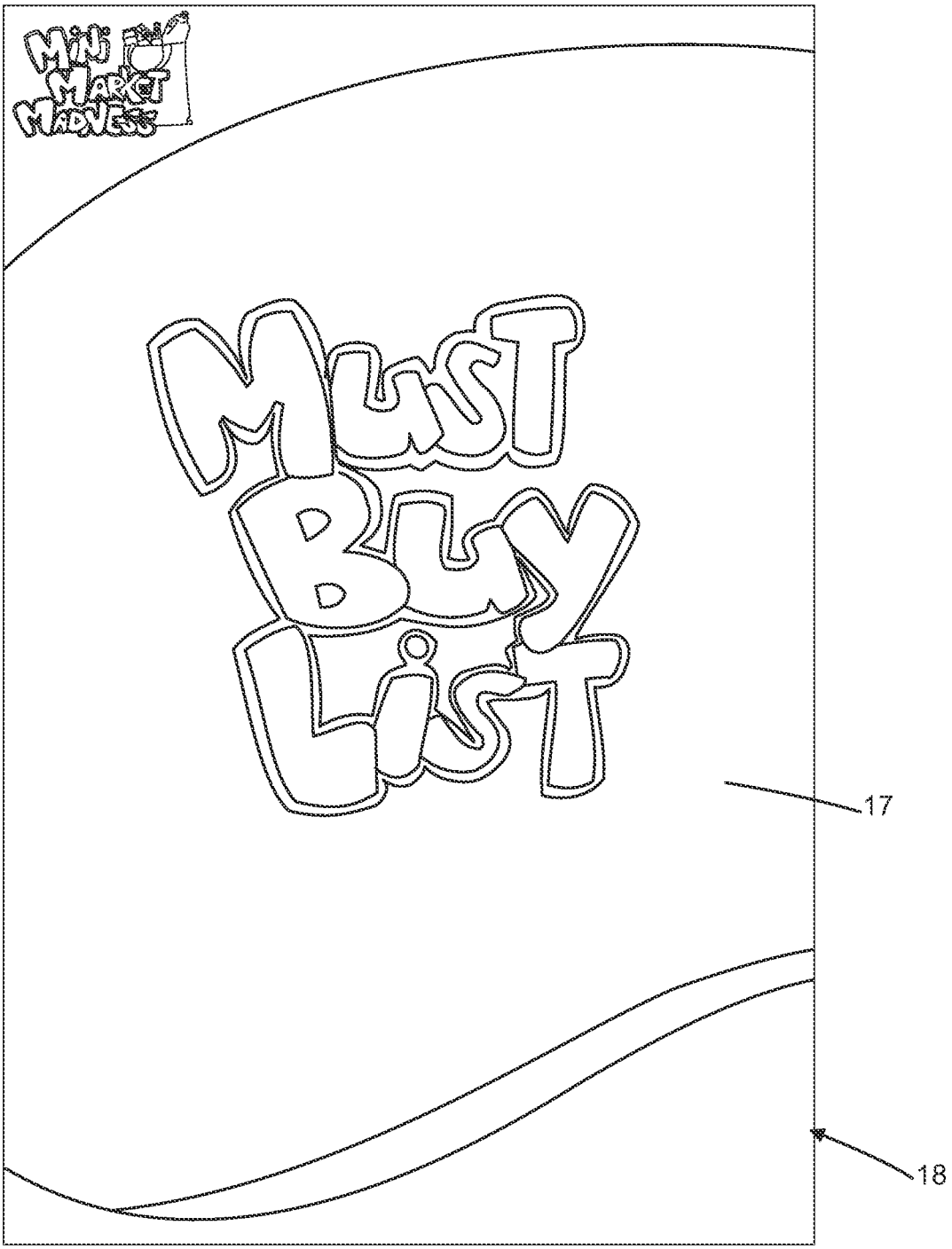
FIG. 7 is a view of the front of the must buy list cards.

FIG. 7 is a view of the back 17 of the must buy list cards 18. All of the must buy cards 18 have the same back. At the beginning of the game the must buy cards are shuffled and placed with the back side up. When a player wins a round, the winner selects a must buy card and places it face up in front of the player. There are three types of must buy cards: milk, bread and eggs. The first player to get all three of the must buy cards wins the game.

Figure 8:
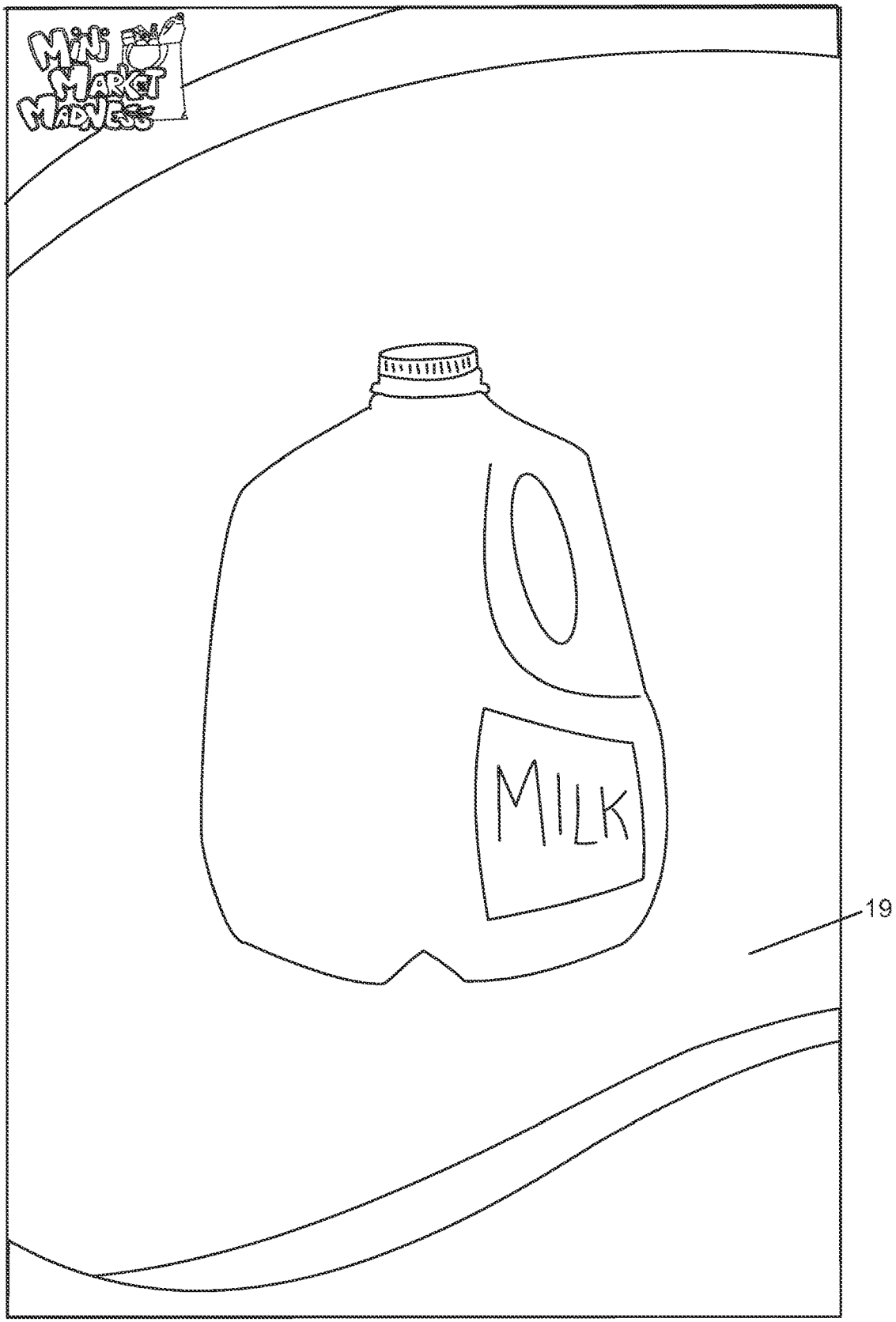
FIG. 8 is a view of the back of a milk must buy card.

FIG. 8 is a view of the face 19 of a milk must buy card.

Figure 9:
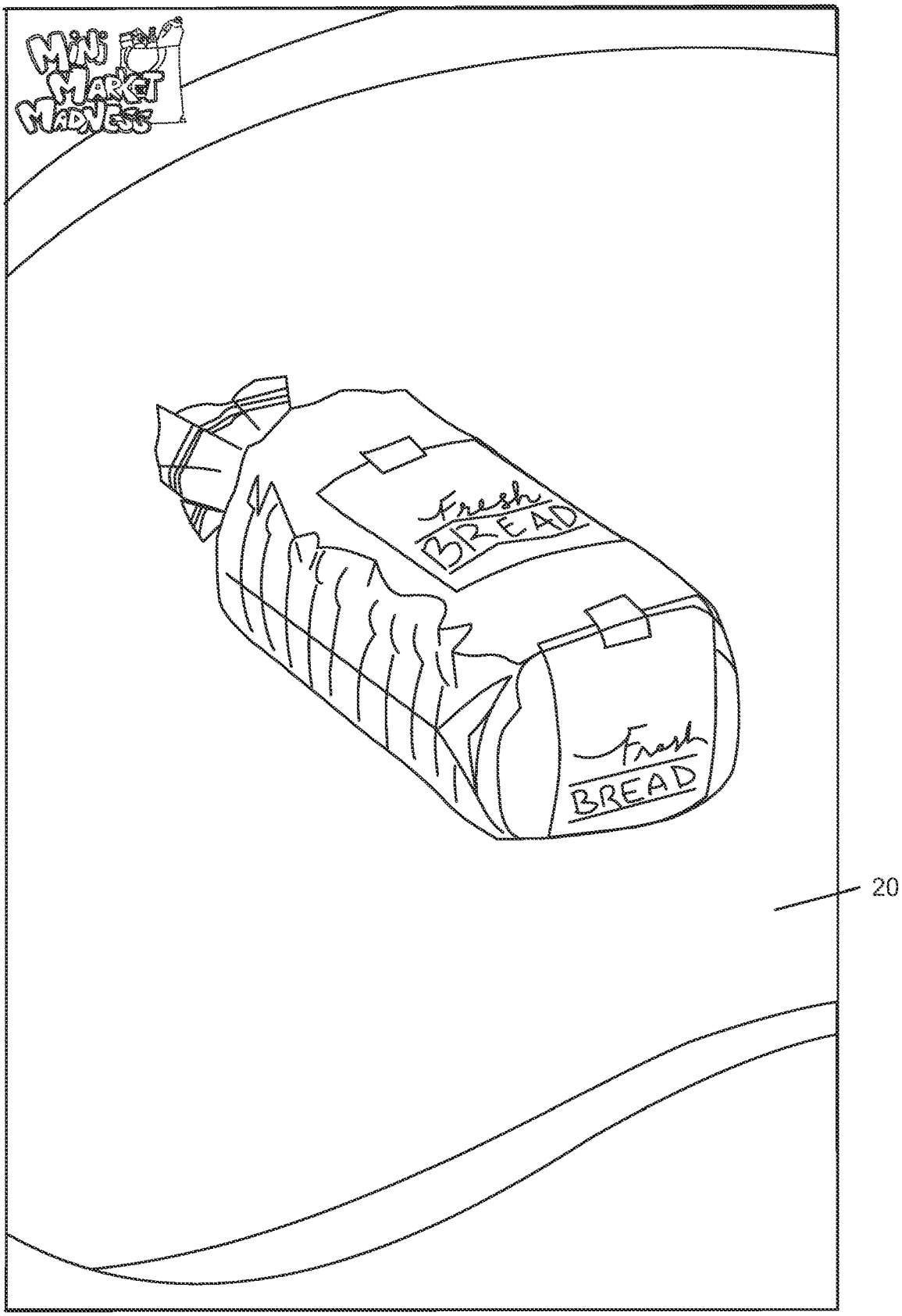
FIG. 9 is a view of the back of a bread must buy card.

FIG. 9 is a view of the face 20 of a bread must buy card.

Figure 10:
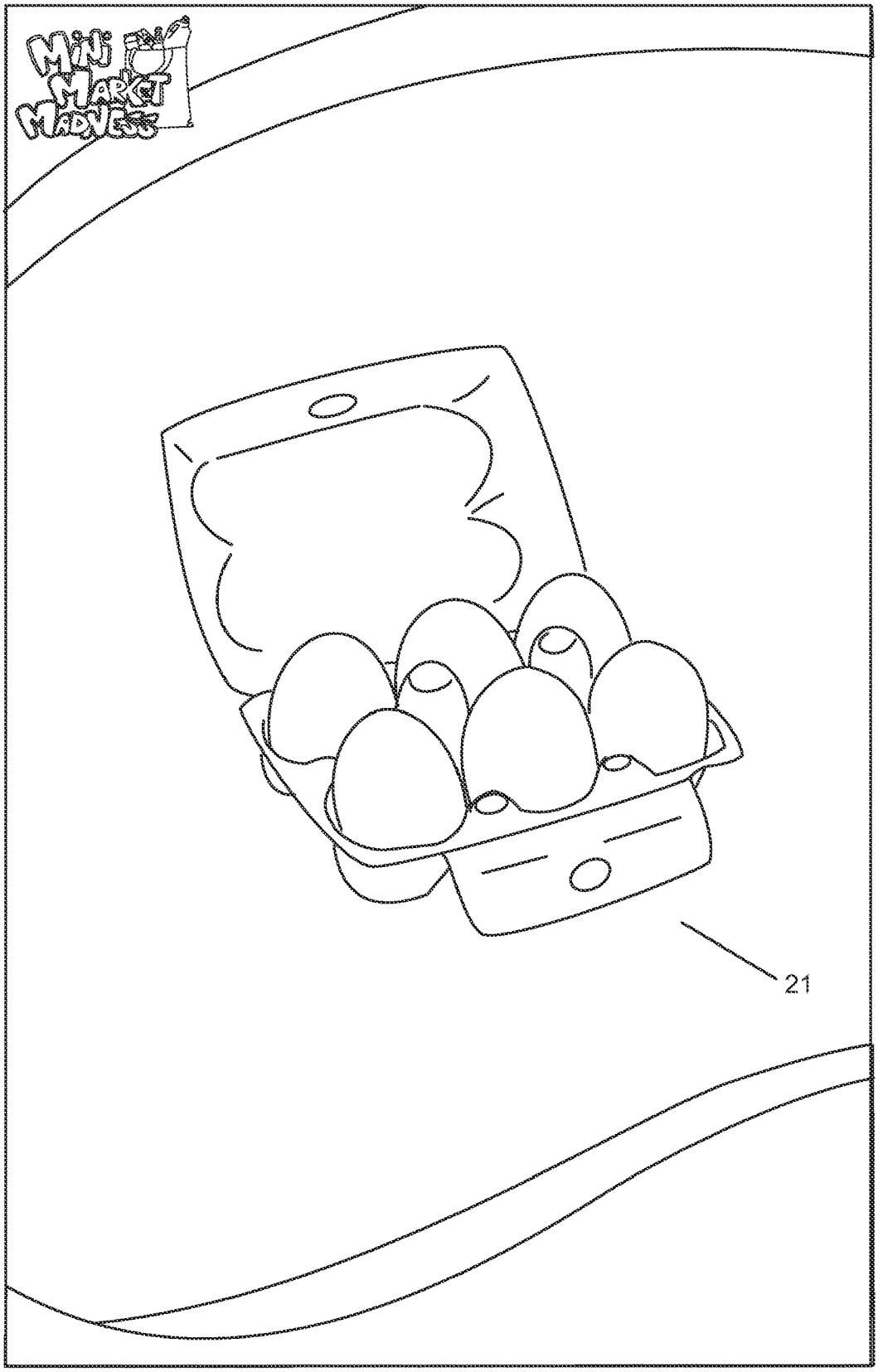
FIG. 10 is a view of the back of an egg must buy card.

FIG. 10 is a view of the face 21 of an egg must buy card.

Figure 11:
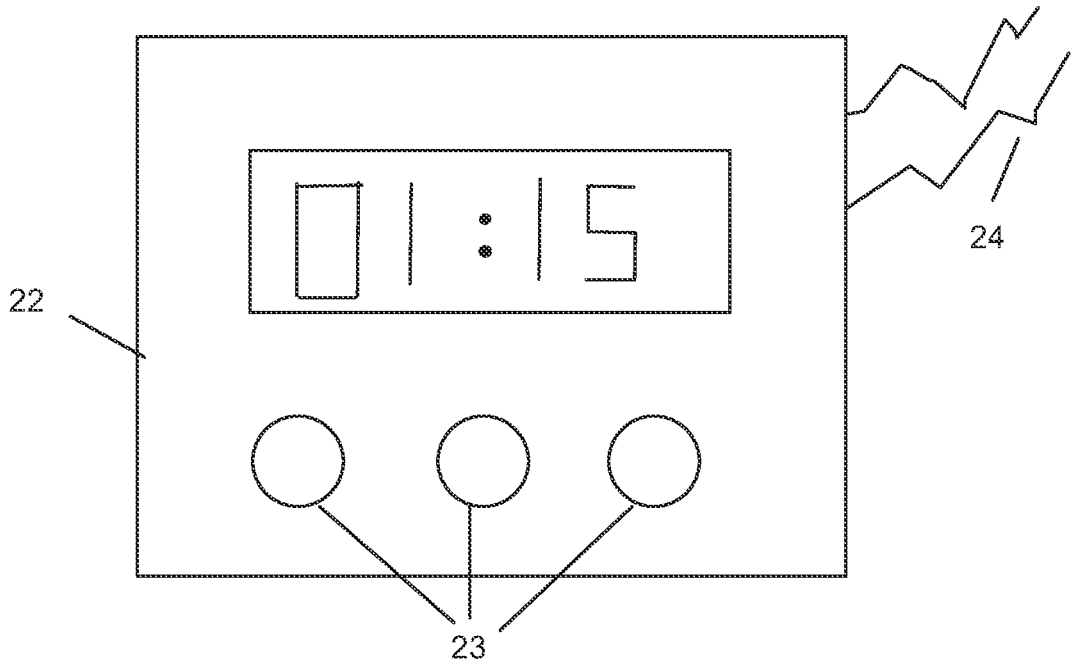
FIG. 11 is a front view of a representative timer used in the game.

FIG. 11 is a front view of a representative timer 22 used in the game. As noted above, each time the players get an item from the tray, they use a timer. In the preferred embodiment, the timer 22 is set for 1 minute and 15 seconds per round. This gives at least one of the players enough time to fill out the shopping list. The timer 22 is a standard timer that has control buttons 23. The timer is battery powered (not shown). When the time is up, the timer will sound with some type of alarm 24. That will alert all players that time is up.

Figure 12:
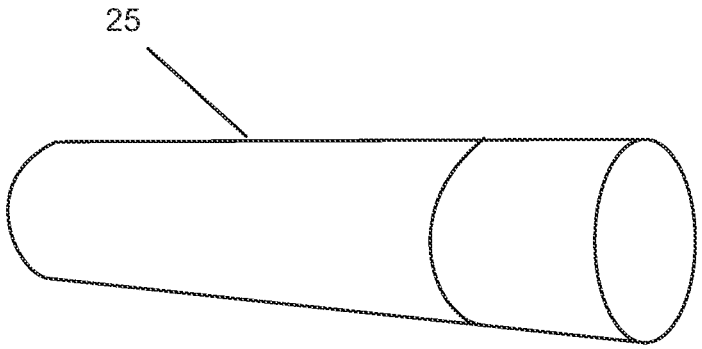
FIG. 12 is a perspective view of a dry erase marker.

FIG. 12 is a detail view of a dry erase marker 25. Each player is given a dry erase marker 25 to mark their shopping list cards. At the end of each round, the shopping list cards are collected and can be cleaned. Then new shopping list cards are passed out for the next round.

The steps of playing the game are as follows:

First, unfold and snap together corners of the game mat.

Second, dump a quantity of game pieces in the center of the mat (tray)

Third, place blue shopping list cards on a pile (face down) on the table.

Fourth, shuffle the pink must buy list cards and place them in a pile (face down) on the table.

Fifth, each Player gets their own shopping basket.

Sixth, set the timer to 1 minute and 15 seconds to start. Then, each player draws a blue shopping list card. Someone is then designated timer, to start the timer by saying "Ready, Set, Go!". Then, each player needs to search the pile of game pieces and find the specific items on their list and put them in their shopping basket. Be careful! Items left on the table and not in the basket will be subtracted from the player's total score. When the timer is up, everyone stops searching. Then, verify each the players baskets by making sure items are correct. (Example: A player has an original candy in their basket when their shopping list specifically said "Berry Blast Flavor" candy). Any items that are incorrect cause one correct item to be subtracted from the list. For example: a player has 6 correct items and one incorrect item. You must take away one of the correct items bringing your total down to 5 correct items. The player with the most correct items then draws a pink must buy card and place it face up in front of them. Finally, players discard their used shopping list cards and draw new ones. That ends a round. These rounds are repeated until someone wins the game. Note: If the players run out of shopping list cards, they simply shuffle the discard pile and reuse them.

There are 3 types of must buy cards: milk, bread, and eggs. To win the game, a player must collect all three.

In the event of a tie during a round:

If two players end up with the same number of correct items in their basket, then the timer is reduced to 30 seconds, and they continue to shop for items to complete their list. During this face-off style tie breaker, if they end up tied again, then the timer is then reduced to 15 seconds.

In the rare event that they are still tied after facing off with just 15 seconds, then both players will draw a pink must buy card.

If there are more than 2 people tied at once the same face-off is played, and all players tied after the 15 second round will draw a pink must buy card.

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

The invention claimed is:

1. A method of playing a shopping game, for a number of players, having a foldable game mat having four corners and at least one snap installed in each of said four corners, a timer having a display and an alarm, a quantity of shopping list cards, a quantity of egg must buy cards, a quantity of milk must buy cards, and a quantity of bread must buy cards, and a quantity of game pieces comprising the steps of:

having a player draw a shopping list card from a pile;

placing a quantity of game pieces in the center of a tray;

setting the timer to 1 minute and 15 seconds and then starting the timer to begin a round of play;

having each player simultaneously search the game pieces in the tray to find the specific items on their list and then putting them in their shopping basket;

stopping the search when the timer is up;

awarding the round to the player with the most correct items and then having that player draw a must buy card from the pile and place it face up in front of them;

having each player discard their used shopping list cards and draw new ones; and repeating the steps of setting and starting the timer through having each player discard their used shopping list cards and drawing new ones for each subsequent round.

2. The method of claim 1 further comprising the steps of:

unfolding and snapping together corners of said foldable game mat to form a tray;

placing a quantity of shopping list cards face down in a pile;

placing a quantity of must buy list face down in a pile; and giving each player a shopping basket.

3. The method of claim 1 further comprising the steps of:

checking each shopping basket when the timer is up to verify items within it are correct; and counting only the verified products in each shopping basket.

4. The method of claim 1 wherein in the event of a tie at the end of a round in which two players end up with the same number of correct items in their shopping basket, then the timer is reduced to 30 seconds, and the players continue to shop for items to complete their list.

5. The method of claim 4 wherein in the event of a further tie then the timer is then reduced to 15 seconds and the players continue to shop for items to complete their list.

6. The method of claim 5 wherein if the players are still tied then both players draw a must buy card.

7. The method of claim 1 further comprising the step of ending the game when a player collects at least one egg must buy card, at least one milk must buy card and at least one bread must buy card.

8. The method of claim 1 wherein the term "game pieces" includes Mini Brands or similar products, as well as cards or photos having images of products depicted on them.

* * * * *